United States Patent [19]

Reitz et al.

[11] 4,135,479

[45] Jan. 23, 1979

[54] PISTON AND CYLINDER FOR TWO-CYCLE ENGINES

[75] Inventors: Johannes Reitz, Heilbronn; Erich Stark, Neckarsulm; Dieter Schneck, Möckmühl, all of Germany

[73] Assignee: Karl Schmidt GmbH, Neckarsulm, Germany

[21] Appl. No.: 751,244

[22] Filed: Dec. 16, 1976

[30] Foreign Application Priority Data

Dec. 19, 1975 [DE] Fed. Rep. of Germany ..... 2557262

[51] Int. Cl.[2] ..... F02B 33/00

[52] U.S. Cl. ..... 123/73 AA; 123/73 PP

[58] Field of Search ..... 123/73 R, 73 A, 73 AA, 123/73 PP

[56] References Cited

U.S. PATENT DOCUMENTS

| | | | |
|---|---|---|---|
| 1,473,602 | 11/1923 | Brockway | 123/73 A |
| 2,926,644 | 3/1960 | Flamm | 123/73 A |
| 2,966,900 | 1/1961 | Ehrlich | 123/73 AA |
| 3,257,997 | 6/1966 | Sheaffer | 123/73 AA |
| 3,257,998 | 6/1966 | Brooks | 123/73 AA |
| 3,412,719 | 11/1968 | Scheaffer et al. | 123/73 A |
| 3,797,467 | 3/1974 | Tenney | 123/73 AA |

FOREIGN PATENT DOCUMENTS

| | | | |
|---|---|---|---|
| 641847 | 2/1937 | Fed. Rep. of Germany | 123/73 A |
| 1092282 | 4/1955 | France | 123/73 A |
| 214687 | 5/1941 | Switzerland | 123/73 AA |
| 1285471 | 8/1972 | United Kingdom | 123/73 A |

*Primary Examiner*—Charles J. Myhre
*Assistant Examiner*—David D. Reynolds
*Attorney, Agent, or Firm*—Sprung, Felfe, Horn, Lynch & Kramer

[57] ABSTRACT

A piston and cylinder for two-cycle engines wherein the fuel-air mixture is precompressed in the crankcase and flows to the combustion chamber through transfer passages formed in the cylinder wall and under the control of the piston movement. The piston skirt is formed with windows or openings adjacent the end faces of the piston pin, the latter being mounted in piston pin bosses carried by bearing brackets depending from the piston head and, when the piston is at its lower dead center, the windows or openings register with the inlet openings of the transfer passages so that the precompressed fuel-air mixture then flows through the interior of the piston, the openings in the piston skirt and the transfer passages and into the combustion chamber itself which contains a depression volume. The windows or openings in the piston skirt have approximately the same size as the inlet openings of the transfer passages which register with the windows when the piston is at its lower dead center and the piston pin bosses have an aerodynamically favorable shape and are joined to the lower frame portions defining the windows and spaced apart as closely as possible whereas the depression volume of the combustion chamber is accommodated to a substantial extent in the piston head.

5 Claims, 4 Drawing Figures

PISTON AND CYLINDER FOR TWO-CYCLE ENGINES

BACKGROUND

This invention relates to a piston and cylinder for two-stroke cycle internal combustion engines in which the fuel-air mixture is precompressed in the crankcase and flows to the combustion chamber through transfer passages formed in the cylinder wall and under the control of the piston movement, and in which the piston skirt is formed with windows adjacent to the end faces of the piston pin, the latter is mounted in piston pin bosses carried by bearing brackets depending from the piston head and, when the piston is at its lower dead center, said windows register with the inlet openings of the transfer passages so that the precompressed fuel-air mixture then flows through the interior of the piston, the windows in the piston skirt, and the transfer passages into the combustion chamber, which comprises a depression volume.

To reduce the resistance to the transfer flow and to simplify the structure of two-stroke cycle internal combustion engines in which the piston controls inlet ports for the fuel-air mixture and outlet ports for the exhaust gas, it is known from German Pat. No. 571,548 and German Pat. No. 1,092,282 to provide the piston itself with means which permit of a flow of the gases along the piston. These arrangements permit of the use of a long piston skirt, affording the known advantages, even in internal combustion engines which have a relatively short stroke. In these known pistons, grooves extend from the free end of the piston skirt to points below the ring zone along the generatrices which extend through the end portions of the piston pin.

From German Pat. No. 692,211 it is also known to provide one or more windows in those portions of the piston skirt which are disposed between the bearings for the piston pin so that the mixture flows through the interior of the piston.

Whereas these known arrangements provide a transfer path which is relatively short because it does not extend throughout the height of the piston, as in the conventional pistons, but only as far as to the ring zone, the cooling action of the flowing mixture and the large quantity of heat transfer to the piston particularly in internal combustion engines operating with a high compression ratio and at high speed result in thermal stresses in the piston.

To avoid this, the last-mentioned known arrangement comprises partitions which constrain the mixture to flow along the piston head. Whereas thermal stresses are avoided and the piston is cooled owing to this feature, the resistance to flow is substantially increased thereby so that the scavenging time is prolonged. Besides, there is a limit to the cross-sectional area, particularly with small pistons designed for a high power so that relatively large bearings are required for the piston pins.

To eliminate these disadvantages it has been proposed to provide two-stroke cycle internal combustion engines in which the fuel-air mixture is precompressed in the crankcase and is transferred through a transfer passage formed in the cylinder wall and under the control of the piston movement, with a piston which has windows which, when the piston is near its lower dead center, are in register with the transfer passages so that the compressed fuel-air mixture then flows through the interior of the piston past the piston pin and through the windows in the piston skirt and the transfer passages to the scavenging ports provided at the outlet end of these transfer passages. In these pistons, the piston pin is mounted in bearing brackets depending from the piston head and the windows are disposed opposite the end faces of the piston pin (Printed German Application No. 1,476,085).

An important disadvantage of that piston resides in that the gas in the interior of the piston is not sufficiently exchanged so that hot spots and their consequences result. The cylinder head is formed with a compact depression, which forms part of the compression chamber and in dependence on the location of the spark plug is often not scavenged at all or only very incompletely scavenged by the fuel-air mixture flowing into the combustion chamber so that there is no exchange of gas or only an incomplete exchange of gas in that depression too and the residual burnt gases which precede the spark plug result in a poor starting performance, particularly when the engine is still hot. This will adversely affect not only the power output but also the composition of the exhaust gases.

SUMMARY

The present invention provides a two-stroke cycle internal combustion engine of the type described first hereinbefore with a piston and cylinder which are so designed that an improved exchange of gas, a complete combustion of the fuel-air mixture, and an improved starting performance, resulting in a satisfactory power output and a satisfactory composition of the exhaust gases, are achieved.

This is accomplished by openings or windows in the piston skirt having approximately the same size as the inlet openings of the transfer passages, which register with said windows when the piston is at its lower dead center, and the piston pin bosses have an aerodynamically favorable shape and are joined to the lower frame portions defining said windows and spaced apart as closely as possible whereas the depression volume of the combustion chamber is accommodated to a substantial extent in the piston head.

As a result of the combination of these features, a large axial cross-section of flow for the fuel-air mixture to be transferred is provided in the interior of the piston so that the volumetric efficiency is distinctly improved. As the fuel-air mixture is transferred, it contacts all portions of the interior of the piston to effect a cooling and lubricates the bearings for the piston pin. Besides, the compact depression which is formed in the piston head and forms part of the combustion chamber can replace entirely or in a major part the combustion chamber depression volume which in accordance with the state of the art is accommodated in the integrally cast cylinder head and which cannot be properly scavenged. This feature of the invention results in an improved scavenging so that an excessive temperature rise of relatively closely confined portions of the piston head is prevented.

According to a further preferred feature of the invention, the transfer passages formed in the cylinder are so designed that the inner sides of the streams of the fuel-air mixture entering the combustion chamber are tangential to edge portions of the depression which forms part of the combustion chamber and is accommodated in the piston head. As a result of this feature the action of these streams to expel the exhaust gases is not adversely affected. When the depression volume of the compression chamber is arranged in accordance with the invention, the spark plug is disposed in the region flown through by the entering fuel-air mixture so that the life of the spark plug is prolonged and the spark plug is always preceded by fresh fuel-air mixture even when the depression formed in the piston head and forming part of the compression chamber has not been completely scavenged. This ensures a satisfactory initiation of the ignition of the entire fuel-air mixture and an excellent starting performance of the internal combustion engine.

In accordance with a preferred feature of the invetion, all or at least 60% of the depression volume of the combustion chamber is accommodated in the piston head and, in the latter case, the other part of the depression volume of the combustion chamber consists of a relatively shallow depression in the cylinder head.

The spacing between adjacent terminal portions of the piston pin bosses is suitably selected to be less than 40% of the piston diameter.

DESCRIPTION OF THE DRAWING

The invention is illustrated by way of example in the drawing, which will be explained more fully hereinafter.

DESCRIPTION

Figure 2:
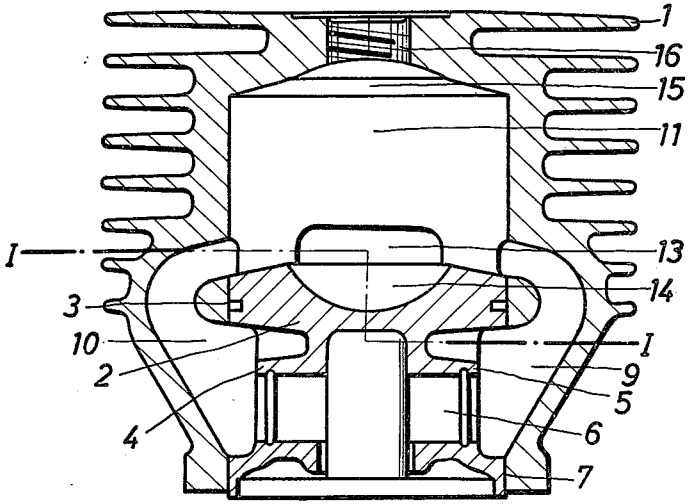
FIG. 2 is a longitudinal sectional view taken on the vertical plane in which the axis of the piston pin is disposed and showing the piston at its lower dead center and the cylinder.
Figure 3:
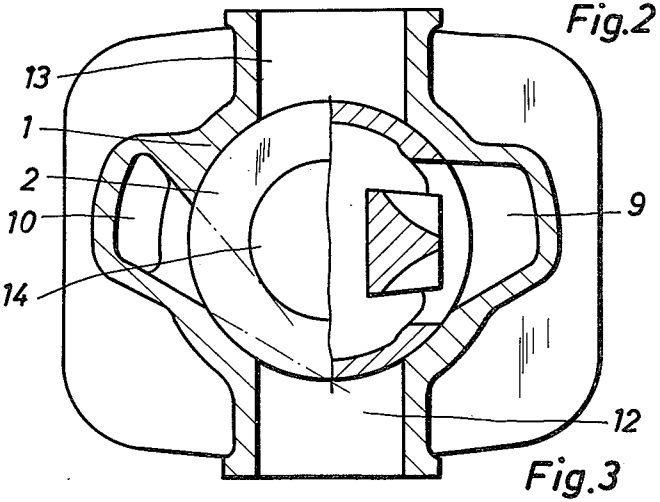
FIG. 3 is a transverse sectional view taken on line I—I in FIG. 2.
Figure 1:
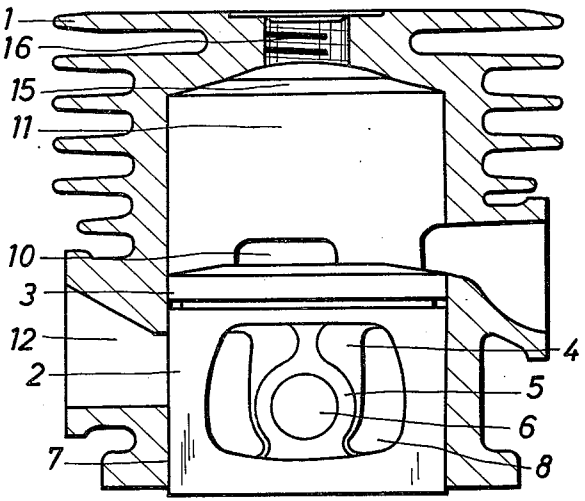
FIG. 1 is a longitudinal sectional view showing a cylinder and taken on a line which is at right angles to the vertical plane in which the axis of the piston pin is disposed, and a sectional view showing the piston at its lower dead center, the view being taken on the end face of the piston pin.

A cylinder 1 is provided with cooling fins and contains a piston 2 shown at its lower dead center. Two bearing brackets 4 are carried by a head 3 of the piston and carry bosses 5, in which the piston pin 6 is mounted. The piston has a skirt 7, which is formed with windows 8 opposite the end faces of the piston pin 6. These windows 8 have the same size as inlet openings of passages 9, 10 serving to transfer the fuel-air mixture into the combustion chamber 11. The windows 8 and the inlet openings of the passages 9, 10 are in register when the piston 2 is at its lower dead center. Inlet openings 12 for the fuel-air mixture and exhaust openings 12 for the exhaust gases are arranged in a plane which is at right angles to the vertical plane in which the axis of the piston pin 6 is disposed. The piston head 3 is formed with a depression 14, which accounts for about 65% of the depression volume of the combustion chamber. The remaining part of the depression volume is contained in a shallow depression 15, which is formed in the cylinder head and into which a spark plug 16 protrudes. The lateral boundary lines of a stream of the fuel-air mixture entering through transfer passage 10 into the combustion chamber 11 are indicated by dash-dot lines in FIG. 3.

Figure 4:
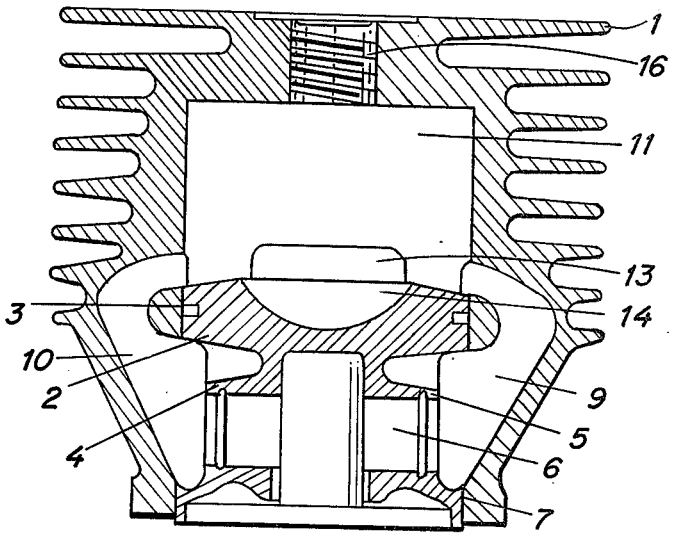
FIG. 4 is a longitudinal sectional view showing an alternate embodiment wherein the depression volume of the combustion chamber is entirely accommodated in the piston head.

In FIG. 4, an alternate embodiment is shown wherein 100% of the depression volume of the combustion chamber is accommodated in the piston head 3.

What we claim is:

1. In a piston and cylinder for two-cycle engines wherein the fuel-air mixture is precompressed in the crankcase and flows to the combustion chamber through transfer passages formed in the cylinder wall and under the control of the piston movement, and wherein the piston skirt is formed with openings adjacent the end faces of the piston pin, said piston pin being mounted in piston pin bosses carried by bearing brackets depending from the piston head and, when the piston is at its lower dead center, said openings register with the inlet openings of the transfer passages so that the precompressed fuel-air mixture then flows through the interior of the piston, through the openings in the piston skirt and through the transfer passages into the combustion chamber which comprises a depression volume, the improvement wherein the openings in the piston skirt have approximately the same size as the inlet openings of the transfer passages which register with said openings when the piston is at its lower dead center, and the piston pin bosses have an aerodynamically favorable shape and are joined to the lower frame portions defining said openings and spaced apart as closely as possible whereas the depression volume of the combustion chamber is accommodated to a substantial extent in the piston head, wherein the aerodynamically favorable shape of the pin bosses includes the bearing brackets having an inwardly opening V-shaped cross-section, the pin bosses connected to the lower frame portions by members having a concave smooth arcuate outer surface and the pin bosses having a continuous arcuate outer surface envelope comprising a double convex and a double concave surface.

2. Two-stroke cycle internal combustion engine of claim 1 wherein the depression volume of the combustion chamber is entirely accommodated in the piston head.

3. Two-stroke cycle internal combustion engine of claim 1 wherein at least 60% of the depression volume of the combustion chamber is accommodated in the piston head and the remainder is accommodated in the form of a relatively shallow depression in the cylinder head.

4. Two-stroke cycle internal combustion engine of claim 1 wherein the distance between adjacent terminal portions of the piston pin bosses is less than 40% of the diameter of the piston.

5. Two-stroke cycle internal combustion engine of claim 1 wherein the outlet openings of the transfer passages lead into the combustion chamber and are so designed that the inner boundaries of the streams of the fuel-air mixture entering the combustion chamber are tangential to edge portions of the depression which forms part of the combustion chamber and is accommodated in the piston head.

* * * * *